US007730594B2

(12) United States Patent
Hsiao

(10) Patent No.: US 7,730,594 B2
(45) Date of Patent: Jun. 8, 2010

(54) CONNECTOR FOR STRETCH STRAPS OF A CHAIR

(76) Inventor: Yun-Chien Hsiao, No. 276, Sec. 2, Hai-Tien Rd., Tainan (TW)

( * ) Notice: Subject to any disclaimer, the term of this patent is extended or adjusted under 35 U.S.C. 154(b) by 505 days.

(21) Appl. No.: 11/705,292

(22) Filed: Feb. 12, 2007

(65) Prior Publication Data

US 2008/0191528 A1 Aug. 14, 2008

(51) Int. Cl.
*A47C 31/04* (2006.01)

(52) U.S. Cl. ..... 24/265 C; 297/452.63

(58) Field of Classification Search ..... None
See application file for complete search history.

(56) References Cited

U.S. PATENT DOCUMENTS 741,973 A * 10/1903 Michael ..... 2/315
4,541,150 A * 9/1985 Brokmann ..... 24/265 C
6,074,013 A * 6/2000 Hsiao ..... 297/440.1

* cited by examiner

*Primary Examiner*—Jack W. Lavinder
(74) *Attorney, Agent, or Firm*—William E. Pelton, Esq.; Cooper & Dunham LLP

(57) ABSTRACT

A connector for stretch straps of a chair is mounted on the chair to hold and stretch a stretch strap with an opposite connector mounted on the chair and has a receiving recess formed inside the connector and a connecting slot formed through the top of the connector and communicating with the receiving recess. One end of the stretch strap extends through the connecting slot to be held by a binder in the receiving recesses. A bottom of the stretch strap is propped out by a top edge of the connecting slot so that a top of the stretch strap is protrudent relative to the top of the connector and a sharp edge formed between the top and the front end of the connector. Thus, a user's body is prevented from contacting with the rigid top and the sharp edge of the connector to comfortably sit on the chair.

5 Claims, 12 Drawing Sheets

CONNECTOR FOR STRETCH STRAPS OF A CHAIR

BACKGROUND OF THE INVENTION

1. Field of the Invention

The present invention relates to a connector for stretch straps of a chair, and more particularly to a connector that is used in pair to hold one end of a stretch strap and to prop out a bottom of the stretch strap to keep human bodies from a sharp edge of the connector.

2. Description of Related Art

With reference to FIGS. 15 and 16, a conventional chair has a frame and multiple stretch strap assemblies (91). The frame has a U-shape bar (93) and two L-shape bars (92). The U-shape bar (93) has a back rail (931) and two legs (932). The back rail (931) has two ends. The legs (932) respectively extend downward from the ends of the back rail (931) and each leg (932) has a middle. The L-shape bars (92) are respectively attached to the legs (932) of the U-shape bar (93) and each L-shape bar (92) has a seat support (921) and a foot (922). The seat support (921) has a proximal end and a distal end. The distal end of the seat support (921) is attached to the middle of a corresponding leg (932) of the U-shape bar (93). The foot (922) extends downward from the proximal end of the seat support (921).

The stretch strap assemblies (91) are respectively connected between the seat supports (921) of the L-shape bars (92) and between the legs (932) of the U-shape bar (93) in juxtaposition for supporting a user's buttocks and back. Each stretch strap assembly (91) has two connectors (911) a stretch strap (912) and a binder (914).

The connectors (911) are respectively mounted securely on the seat supports (921) of the L-shape bars (92) and the legs (932) of the U-shape bar (93). Each connector (911) has a top, a front end, a rear end, a receiving recess (9111), two connecting holes (9112), a mounting ear (9113), multiple mounting holes (9114) and multiple fasteners (9115). The receiving recess (9111) is formed inside the connector (911). The connecting holes (9112) are formed in the front end of the connector (911) and communicate with the receiving recess (911). The mounting ear (9113) is formed on and protrudes from the rear end of the connector (911) and is mounted securely on the seat support (921) of a corresponding L-shape bar (92) or the leg (932) of a corresponding U-shape bar (93). The mounting holes (9114) are formed through the mounting ear (9113) of the connector (911). The fasteners (9115) are mounted through the mounting holes (9114) and penetrate into the seat support (921) of the corresponding L-shape bar (92) or into the leg (932) of the corresponding U-shape bar (93) to secure the connector (911) on the seat support (921) of the L-shape bar (92) or on the leg (932) of the U-shape bar (93).

The stretch strap (912) is elastic, is connected between the connectors (911), extends through the connecting holes (9112) in the connectors (911) to form a loop and has a top and two ends. The ends of the stretch strap (912) are overlapped and bound together in the receiving recess (9111) of one of the connectors (911) of the stretch strap assembly (91). The juxtaposed loops formed by the stretch straps (912) of the stretch strap assemblies (91) form an elastic seat and an elastic seat back for a user's buttocks and back to comfortably sit on and recline on.

The binder (914) is mounted around the overlapped ends of the stretch strap (912) to bind the ends together and is larger than the connecting holes to prevent the stretch strap (912) from detaching from the connecting slots (9112) in the connector (911).

However, a sharp edge is formed between the front end and the top of the connector (911). Because the sharp edge and the top of the connector (911) are protrudent relative to the top of the stretch strap (912), when the user sits on the chair, the user's buttocks and back may contact with the sharp edge and the rigid top of the connectors (911) and causes unease tactile feeling. Furthermore, the sharp edge may rub and fray the user's clothes.

SUMMARY OF THE INVENTION

The primary objective of the present invention is to provide a connector for stretch straps of a chair to mitigate or obviate the aforementioned problems of the conventional connector.

The connector is mounted on a seat support of a L-shape bar or a leg of a U-shape bar of a chair to hold and stretch a stretch strap with an opposite connector mounted on a seat support of the other L-shape bar or a leg of the other U-shape bar of the chair. The connector has a top, a bottom, a front end, a rear end, a receiving recess and a connecting slot. The receiving recess is formed inside the connector. The connecting slot is formed through the top of the connector, communicates with the receiving recess and has a top edge. Two ends of the stretch strap or a loop formed by the stretch strap can respectively extend into the receiving recesses in the opposite connectors through the connecting slots to be respectively held by a binder in the receiving recess to be prevented from detaching from the connecting slot. Thus, the stretch strap or the loop is stretched between the opposite connectors to form a seat or a seat back with other stretched straps or loops connected between other pairs of connectors mounted on the chair.

With the connecting slot formed through the top of the connector, the top edge of the connecting slot props out a bottom of the stretch strap extending through the connecting slot so that a top of the stretch strap is protrudent relative to the top of the connector. Therefore, the rigid top and a sharp edge formed between the top and the front end of the connector are prevented from contacting with a user's buttocks and back. Accordingly, the user can sits on the chair with a comfortable tactile feeling and the user's clothes are kept from rubbing and fraying by the sharp edges of the connectors.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
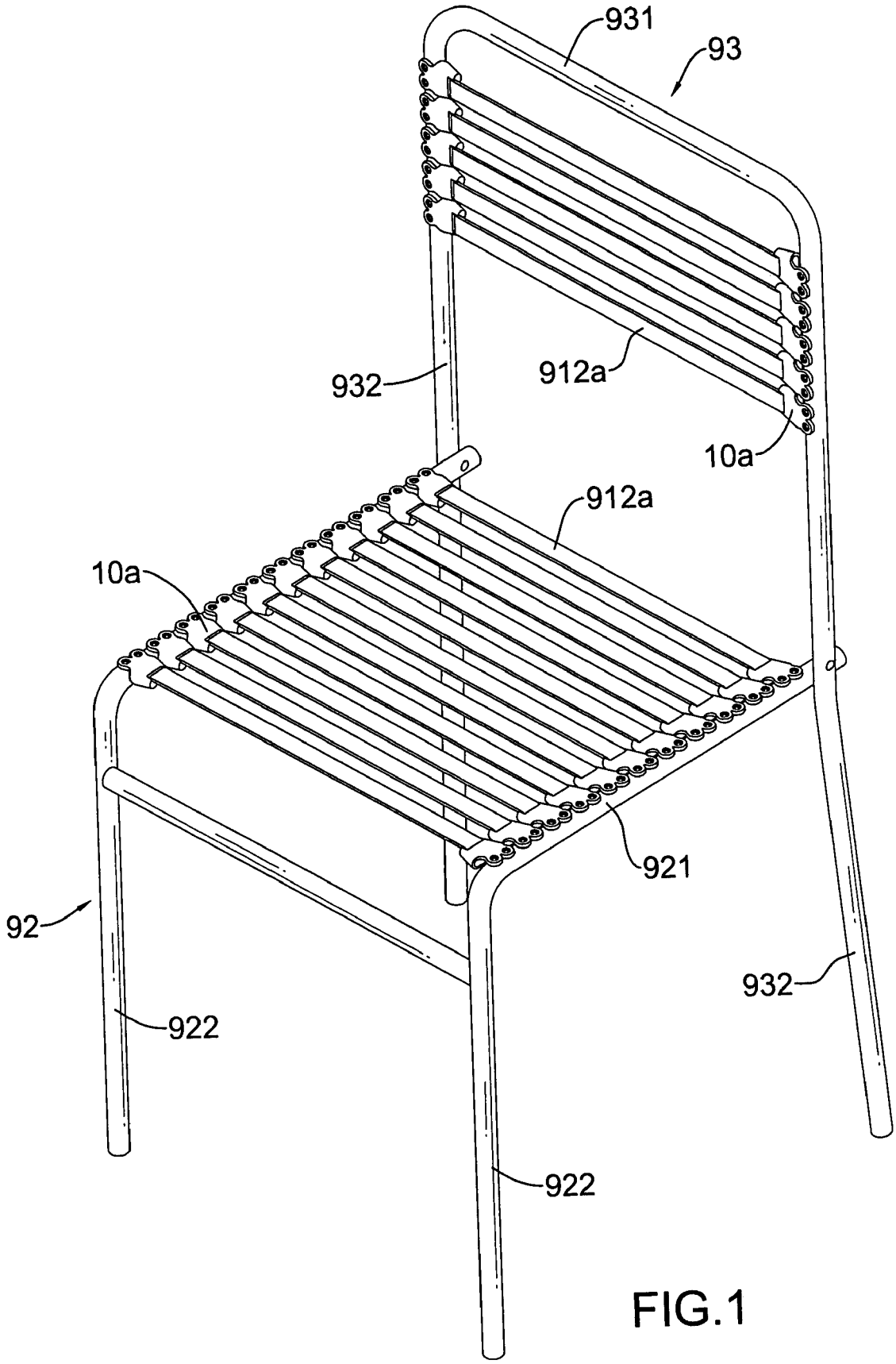
FIG. 1 is a perspective referenced view of a chair with multiple first embodiments of connectors for connecting stretch straps in accordance with the present invention.
Figure 2:
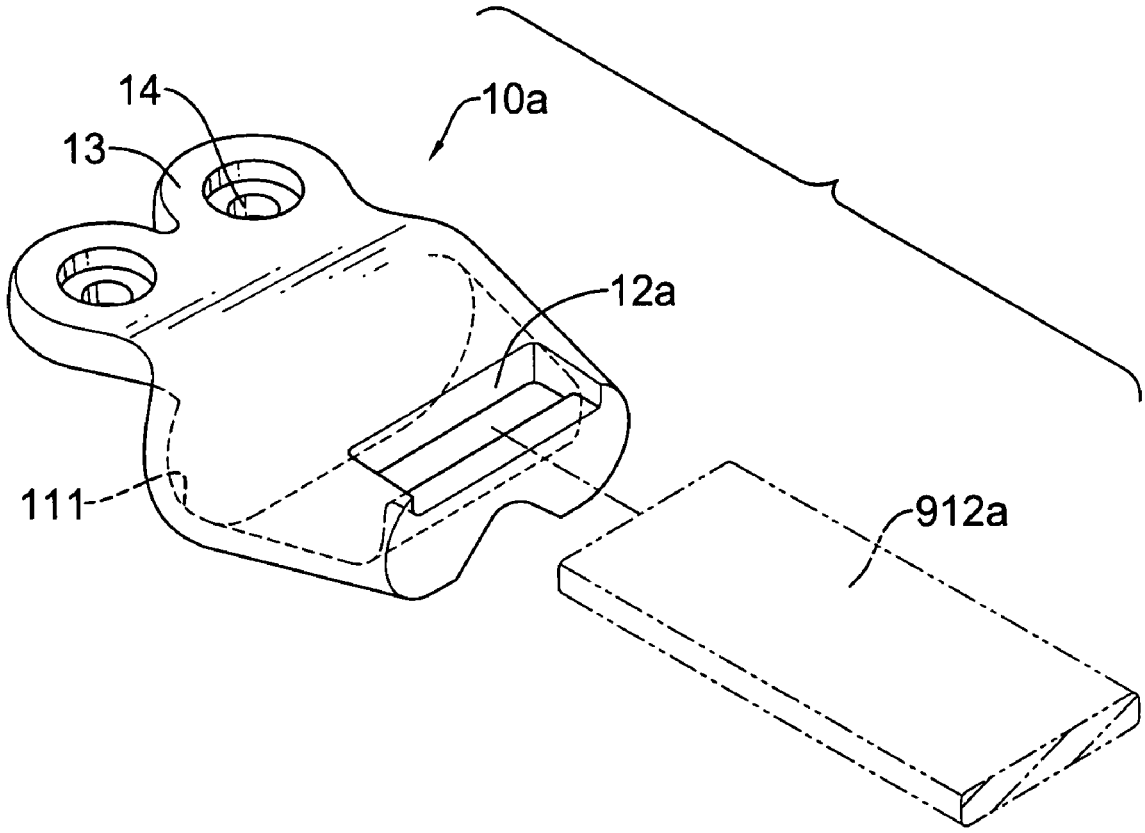
FIG. 2 is an exploded perspective view of a stretch strap with the connector in FIG. 1.
Figure 3:
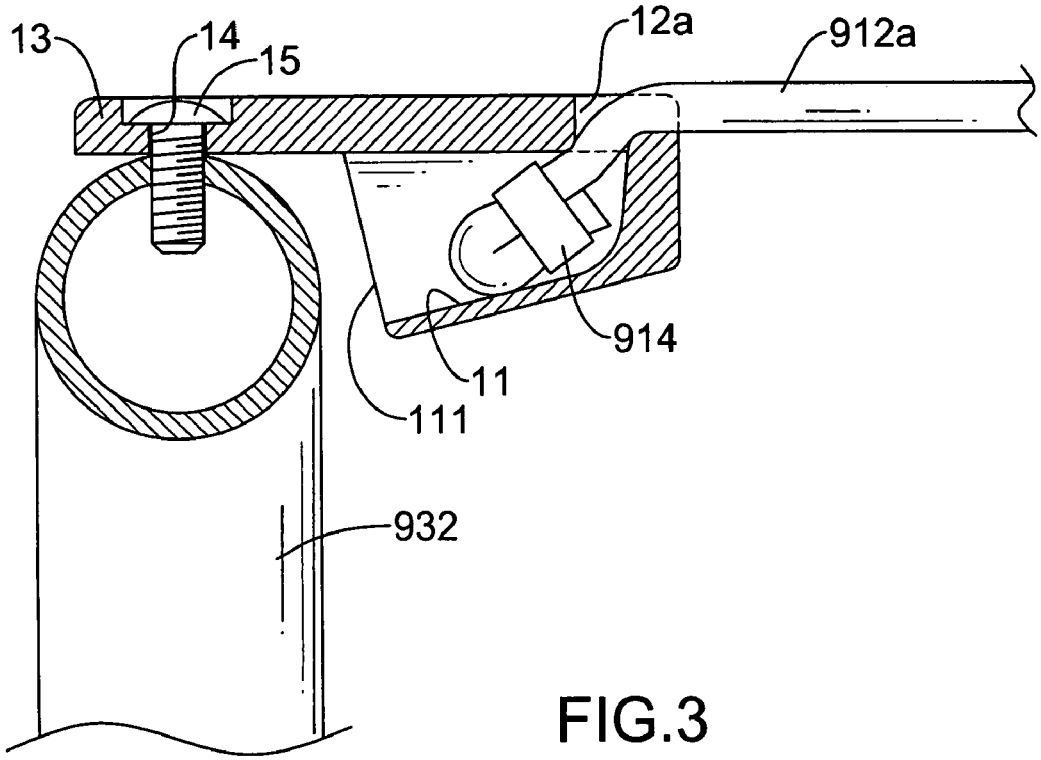
FIG. 3 is an enlarged rear view in partial section of the chair in FIG. 1.
Figure 5:
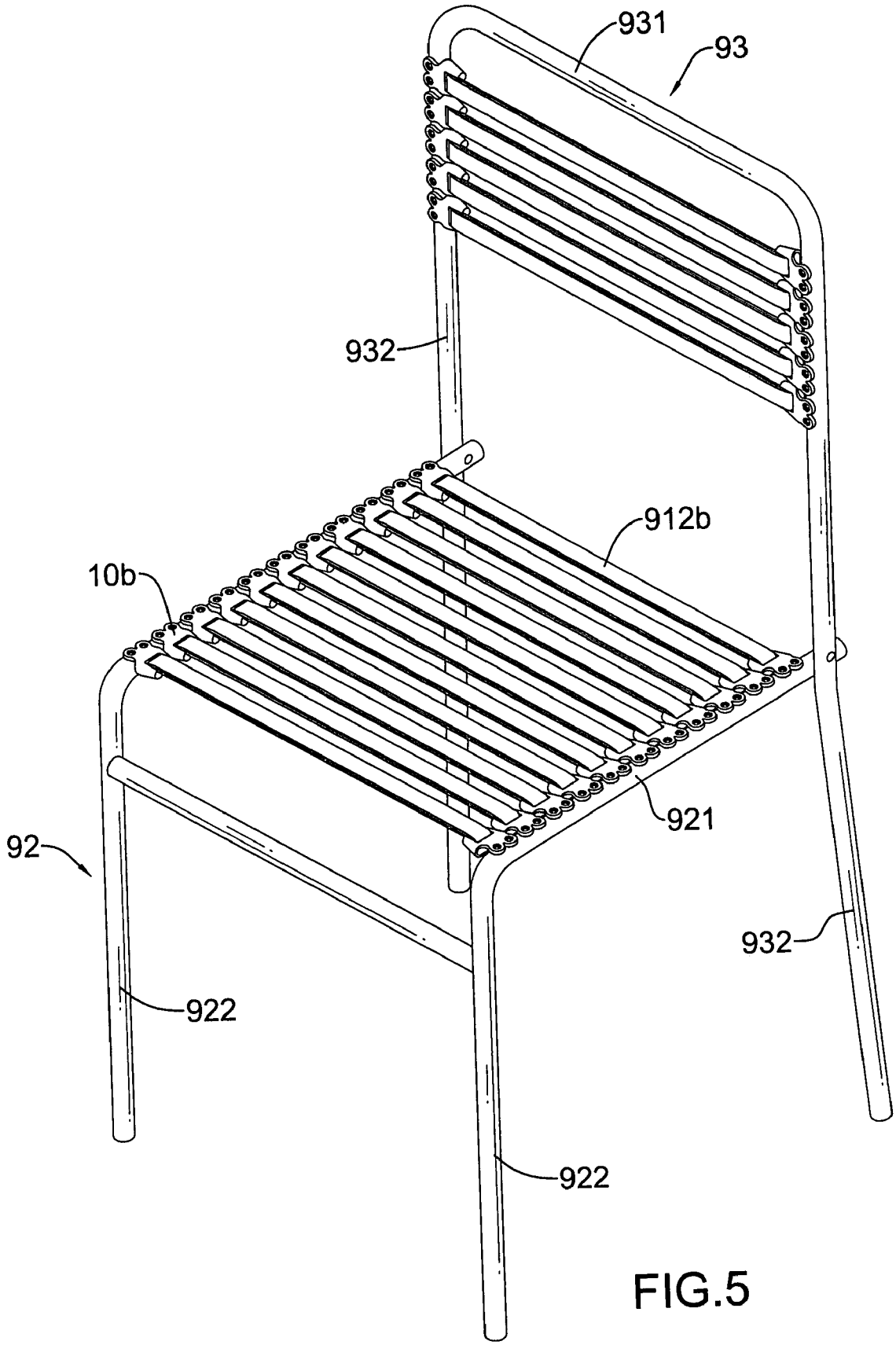
FIG. 5 is a perspective referenced view of a chair with multiple second embodiments of connectors for connecting stretch straps in accordance with the present invention.
Figure 6:
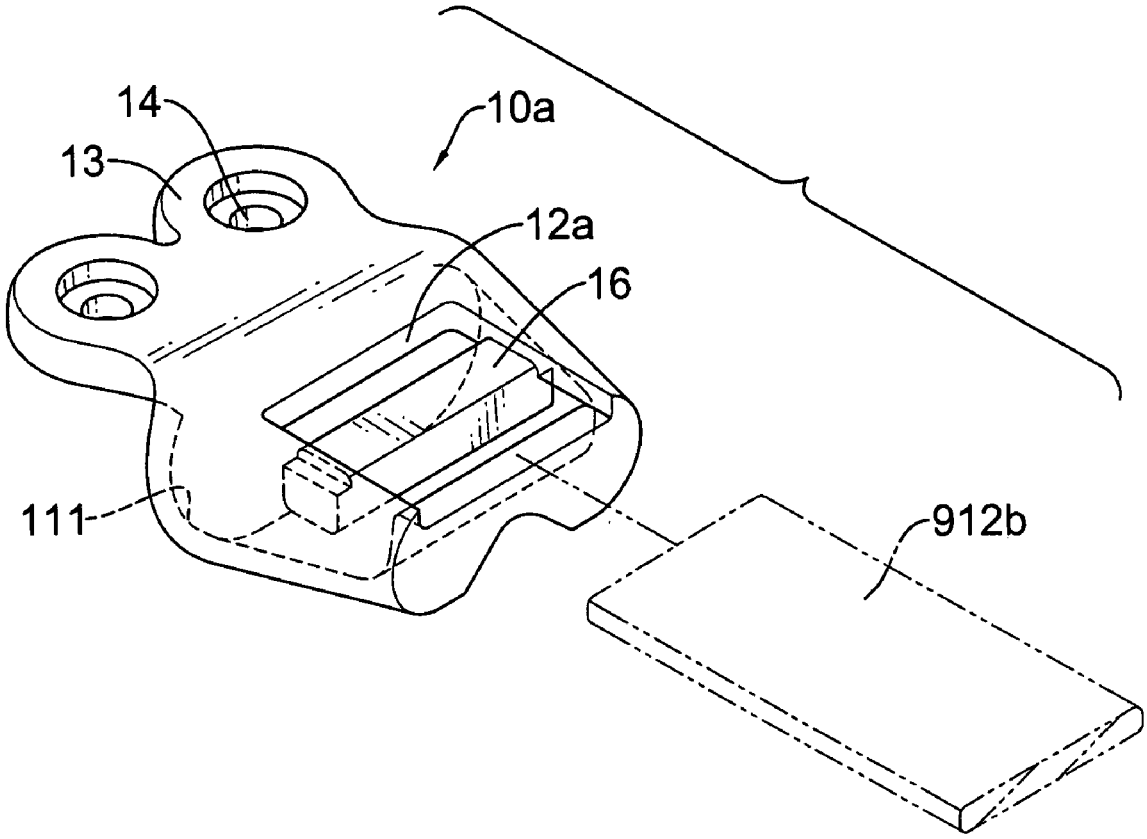
FIG. 6 is an exploded perspective view of a stretch strap with the connector in FIG. 5.
Figure 9:
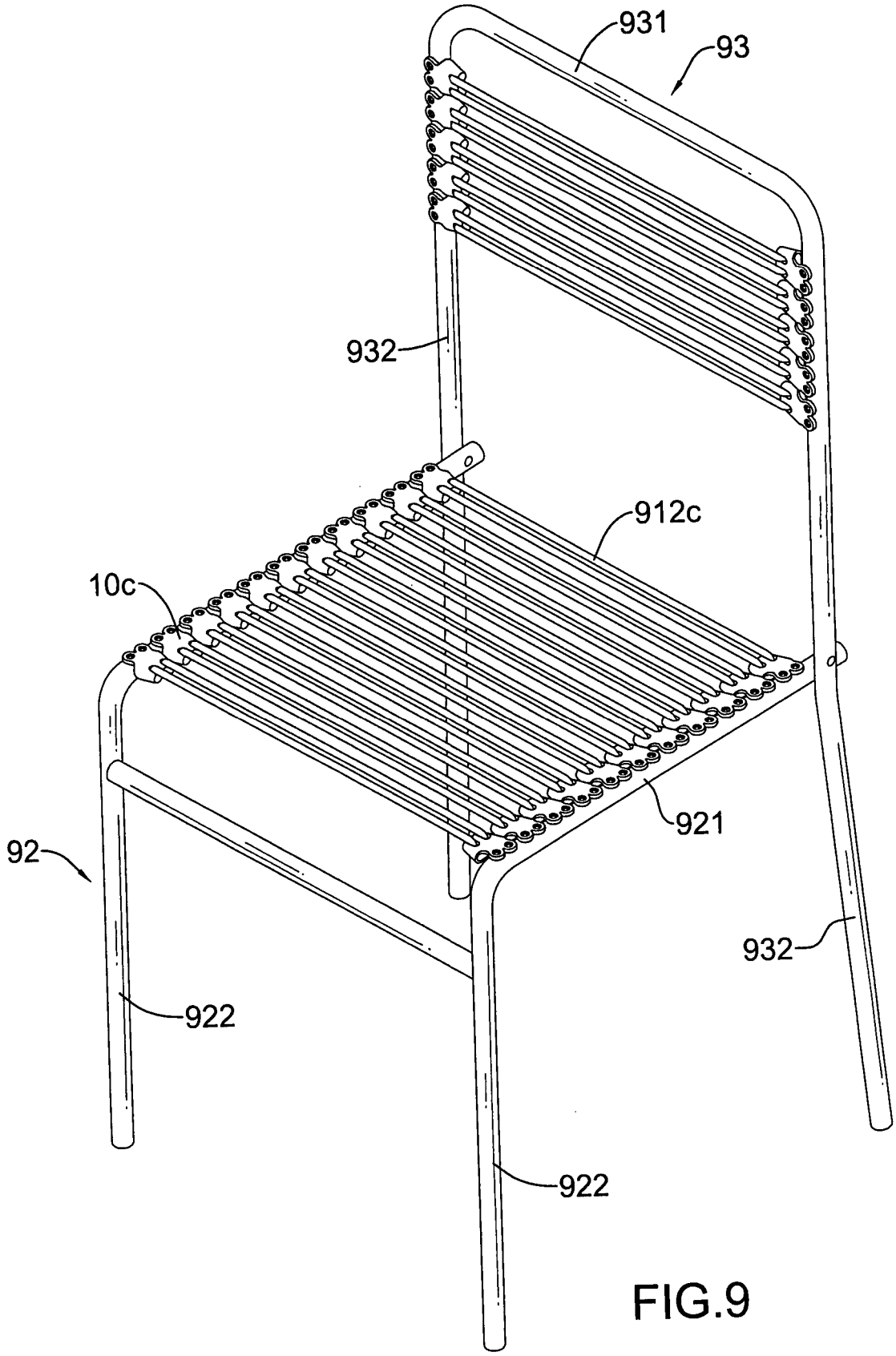
FIG. 9 is a perspective referenced view of a chair with multiple third embodiments of connectors for connecting stretch straps in accordance with the present invention.
Figure 10:
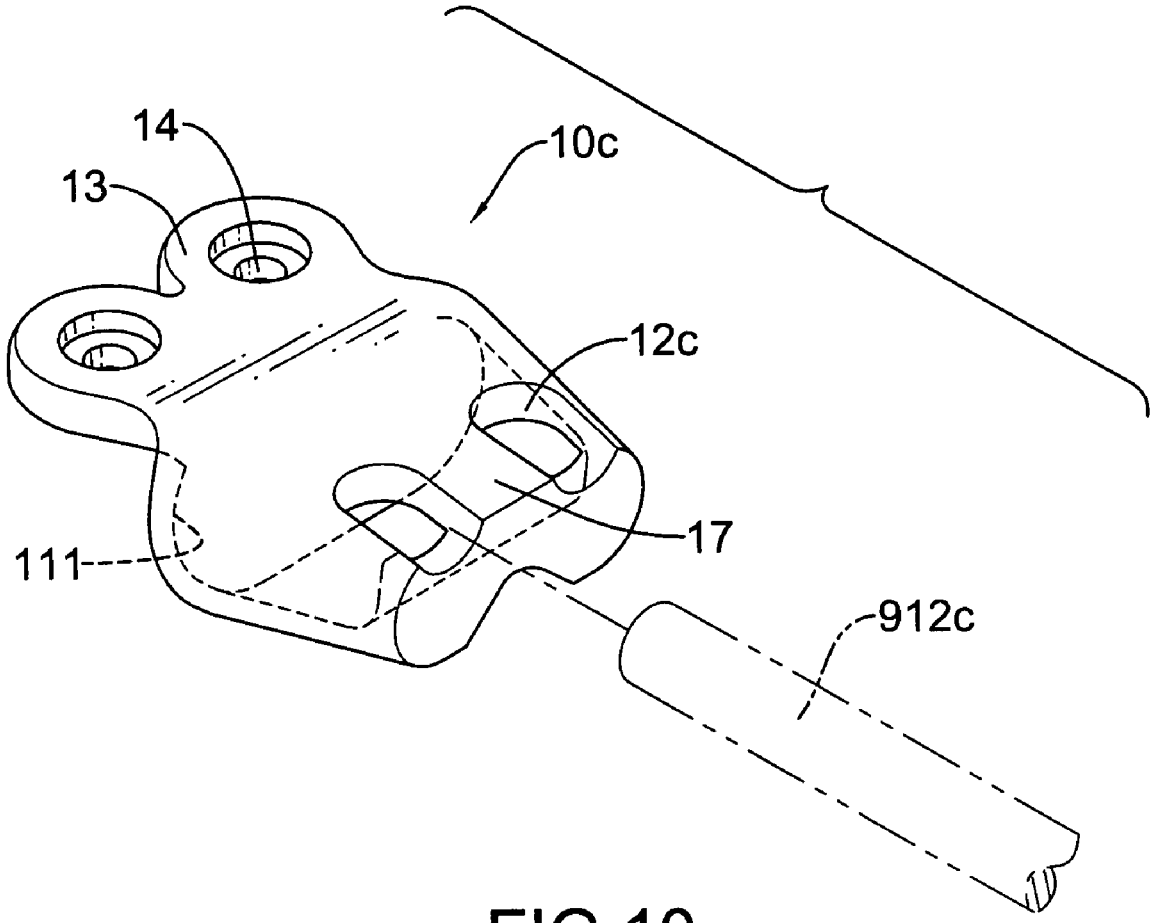
FIG. 10 is an exploded perspective view of a stretch strap with the connector in FIG. 9.

With reference to FIGS. 1, 5 and 9, a connector (10*a*, 10*b*, 10*c*) in accordance with the present invention is used in a chair for connecting stretch straps (912*a*, 912*b*, 912*c*). Since the chair is essentially conventional and is known to people of ordinary skill in the art related to the present invention, further description would be redundant with the description of the prior art and has been omitted.

Multiple connectors (10*a*, 10*b*, 10*c*) in accordance with the present invention are used in pairs and are respectively and securely mounted on two seat supports (921) of two L-shape bars (92) and two legs (932) of a U-shape bar (93) of a frame of the chair for connecting the stretch straps (912*a*, 912*b*, 912*c*) to form a seat and a seat back.

With further reference to FIGS. 2-3, 6-7 and 10-11, each connector (10*a*, 10*b*, 10*c*) comprises a top, a bottom, a front end, a rear end, a receiving recess (11), a connecting slot (12*a*, 12*b*, 12*c*), a mounting ear (13), at least one mounting hole (14) and at least one fastener (15).

The receiving recess (11) is formed inside the connector (10*a*, 10*b*, 10*c*) and may have an opening (111). The opening (111) of the receiving recess (11) communicates with the rear end of the connector (10*a*, 10*b*, 10*c*). The connecting slot (12*a*, 12*b*, 12*c*) is formed through the top of the connector (10*a*, 10*b*, 10*c*), communicates with the receiving recess (11), has a top edge and may be implemented in several ways.

Figure 4:
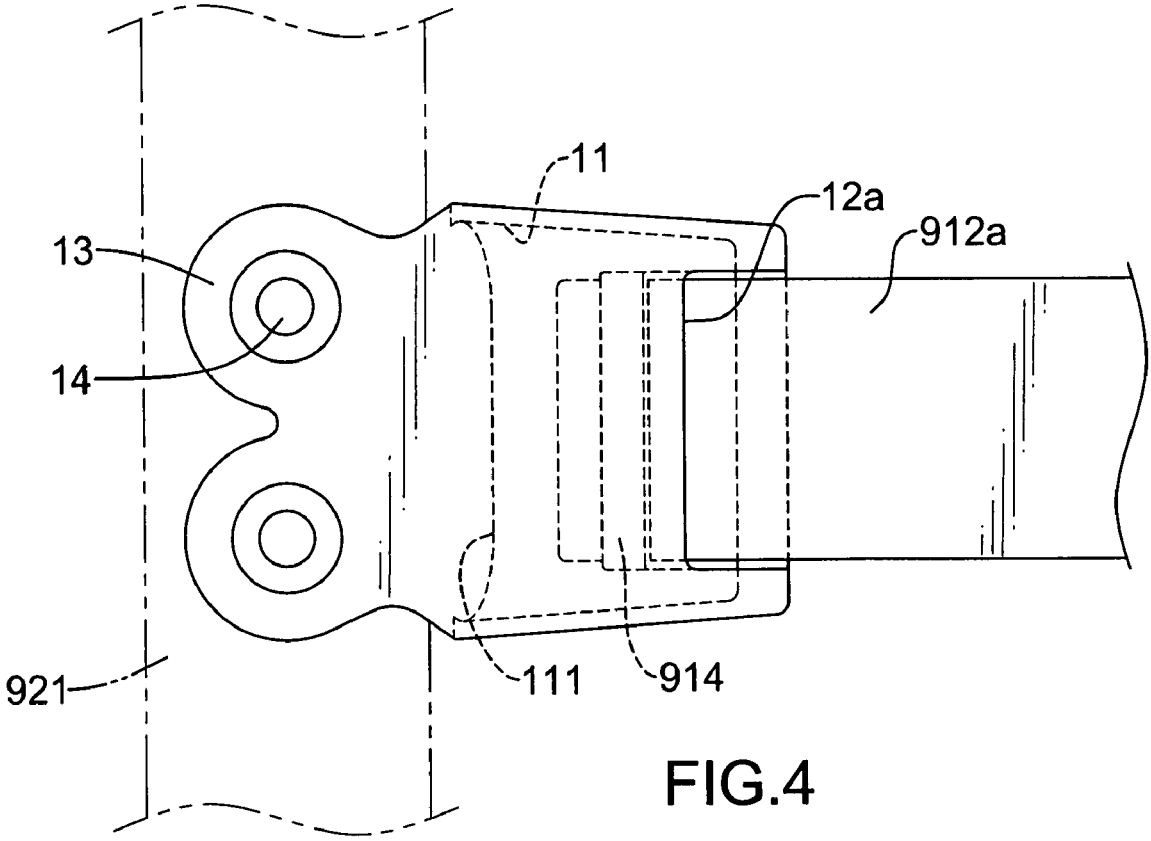
FIG. 4 is an enlarged top view of the chair in FIG. 1.

With further reference to FIG. 4, in a first embodiment of the connecting slot (12*a*), the connecting slot (12*a*) is vacant for receiving a broad stretch strap (912*a*).

The broad stretch strap (912*a*) is elastic and has a top, a bottom and two folded ends. The folded ends of the broad stretch strap (912*a*) respectively extend through the connecting slots (12*a*) in two corresponding connectors (10*a*) respectively mounted on the seat supports (921) of the L-shape bars (92) or on the legs (932) of the U-shape bar (93) to be received in the receiving recesses (11) in the corresponding connectors (10*a*). Each folded end of the broad stretch strap (912*a*) is held securely by a binder (914) larger than the connecting slot (12*a*) to be prevented from detaching from the connecting slots (12*a*). The binder (914) is smaller than the opening (11) of the receiving recess (11) and can be disposed in the receiving recess (11) from the opening (11).

Figure 7:
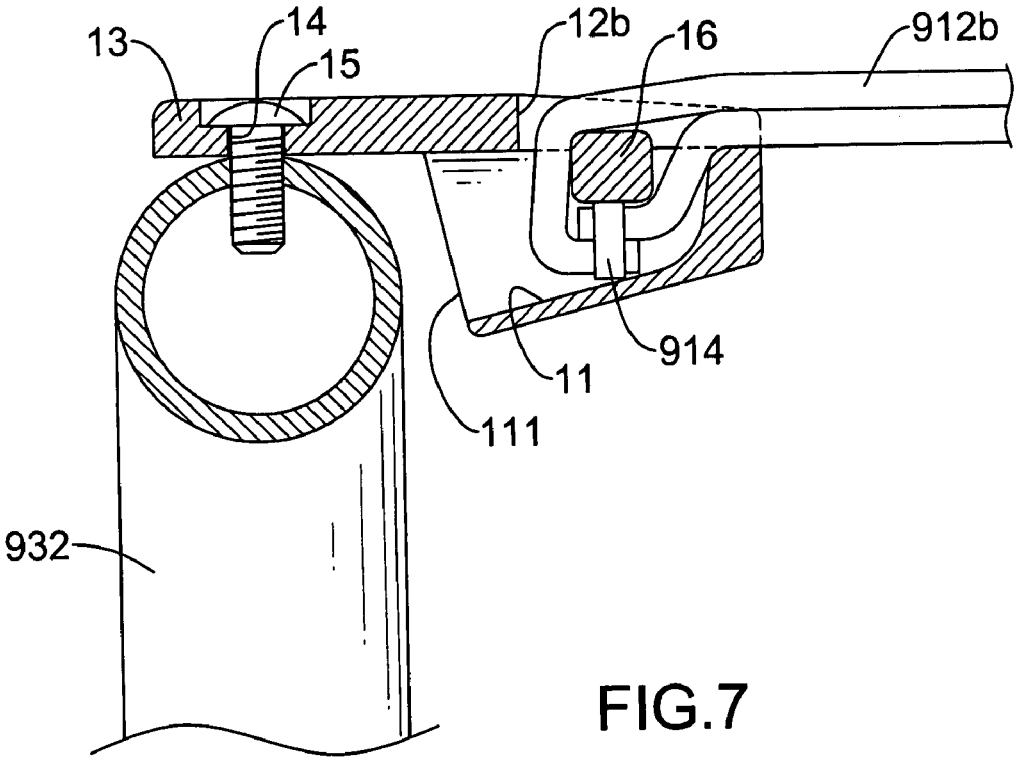
FIG. 7 is an enlarged rear view in partial section of the chair in FIG. 5 with a broad stretch strap forming a loop.
Figure 8:
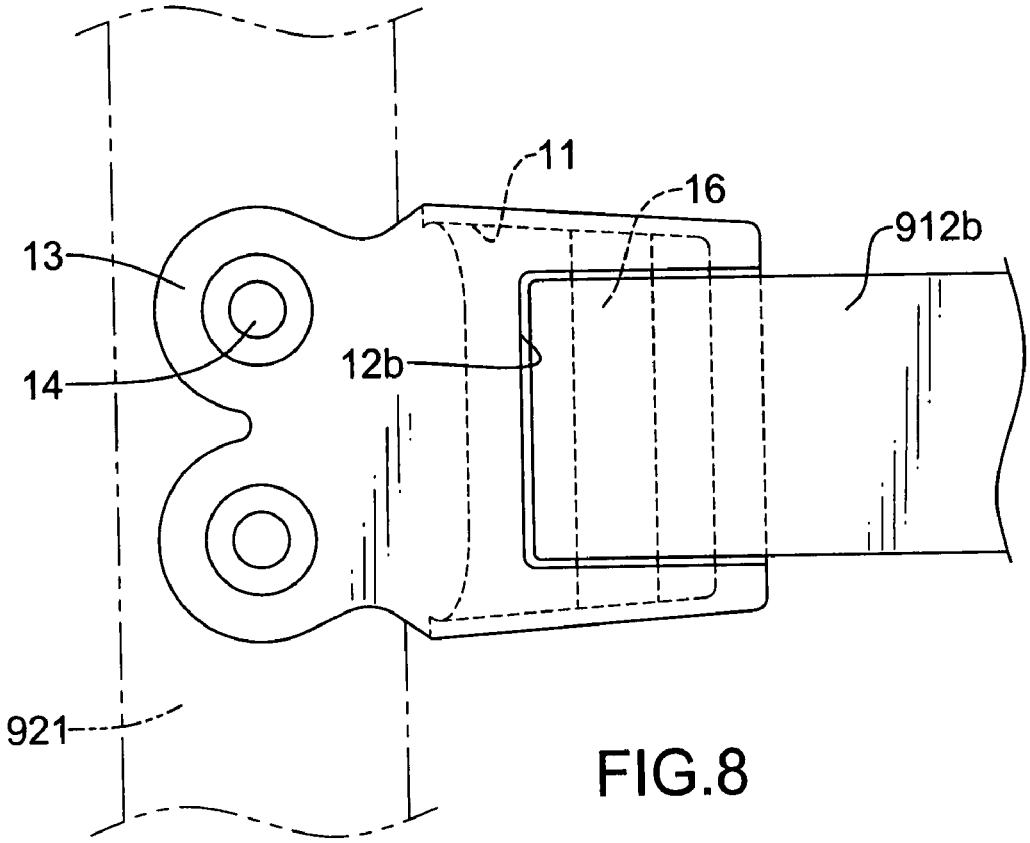
FIG. 8 is an enlarged top view of the chair in FIG. 5 with a broad stretch strap forming a loop.
Figure 13:
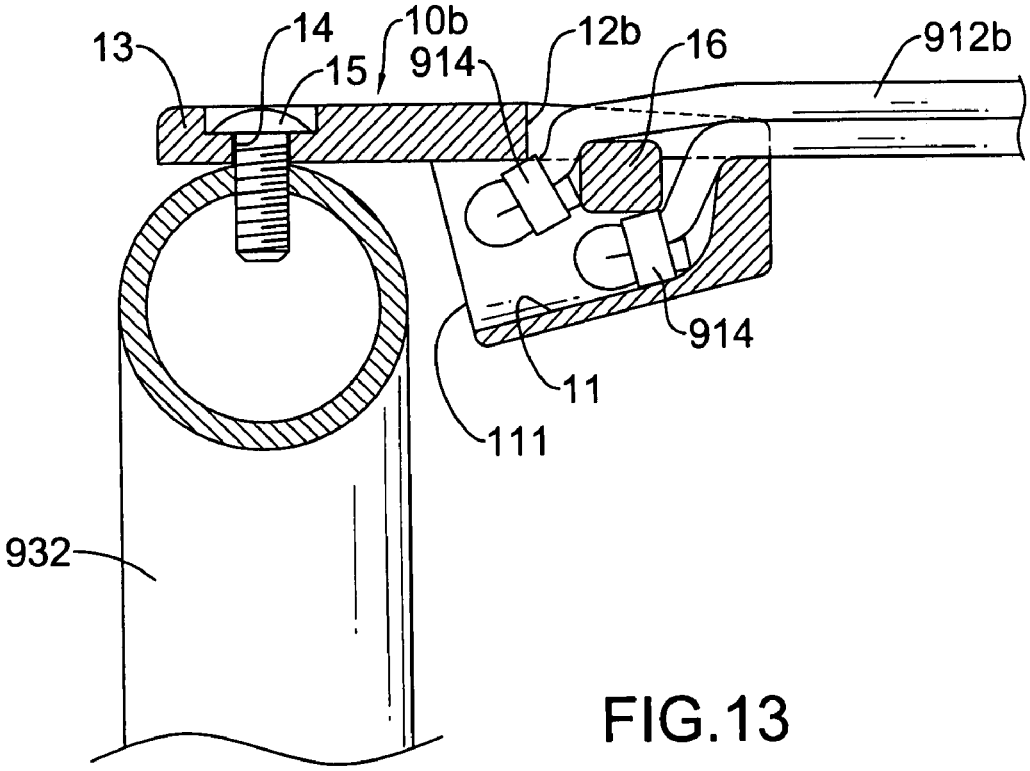
FIG. 13 is an enlarged rear view in partial section of a chair with multiple second embodiments of connectors in accordance with the present invention showing that two folded ends of a broad stretch strap are respectively held in two minor slots.

With further reference to FIGS. 7, 8 and 13, in a second embodiment of the connecting slot (12*b*), the connecting slot (12*b*) has a retaining beam (16). The retaining beam (16) is formed transversely in the connecting slot (12*b*) to form two minor slots in the connecting slot (12*b*) for retaining a broad stretch strap (912*b*, 912*b*') in several manners.

With further reference to FIGS. 7 and 8, in a first manner to retain the broad stretch strap (912*b*), the broad stretch strap (912*b*) is elastic, extends through the minor slots in the connecting slots (12*b*) in two corresponding connectors (10*b*) respectively mounted on the seat supports (921) of the L-shape bars (92) or on the legs (932) of the U-shape bar (93), encircles the retaining beams (16) of the connectors (10*b*) to form a loop and has a top, a bottom and two ends. The ends of the broad stretch strap (912*b*) are overlapped together in the receiving recess (11) of one of the connectors (10*b*) and are held securely by a binder (914) larger than the minor slots to be prevented from detaching from the connecting slots (12*b*). The binder (914) is smaller than the opening (11) of the receiving recess (11) and can be disposed in the receiving recess (11) from the opening (11).

With further reference to FIG. 13, in a second manner to retain the broad stretch strap (912*b*'), the broad stretch strap (912*b*') is elastic, extends through the minor slots in the connecting slots (12*b*) in two corresponding connectors (10*c*) respectively mounted on the seat supports (921) of the L-shape bars (92) or on the legs (932) of the U-shape bar (93) and has a top, a bottom and two folded ends. The folded ends of the broad stretch strap (912*b*') are respectively held in the minor slots in the connecting slot (12*b*) in one of the corresponding connectors (10*b*). Each folded end of the broad stretch strap (912*b*') is held securely by a binder (914) larger than the minor slot to be prevented from detaching from the connecting slot (12*b*). The binder (914) is smaller than the opening (11) of the receiving recess (11) and can be disposed in the receiving recess (11) from the opening (11).

Figure 11:
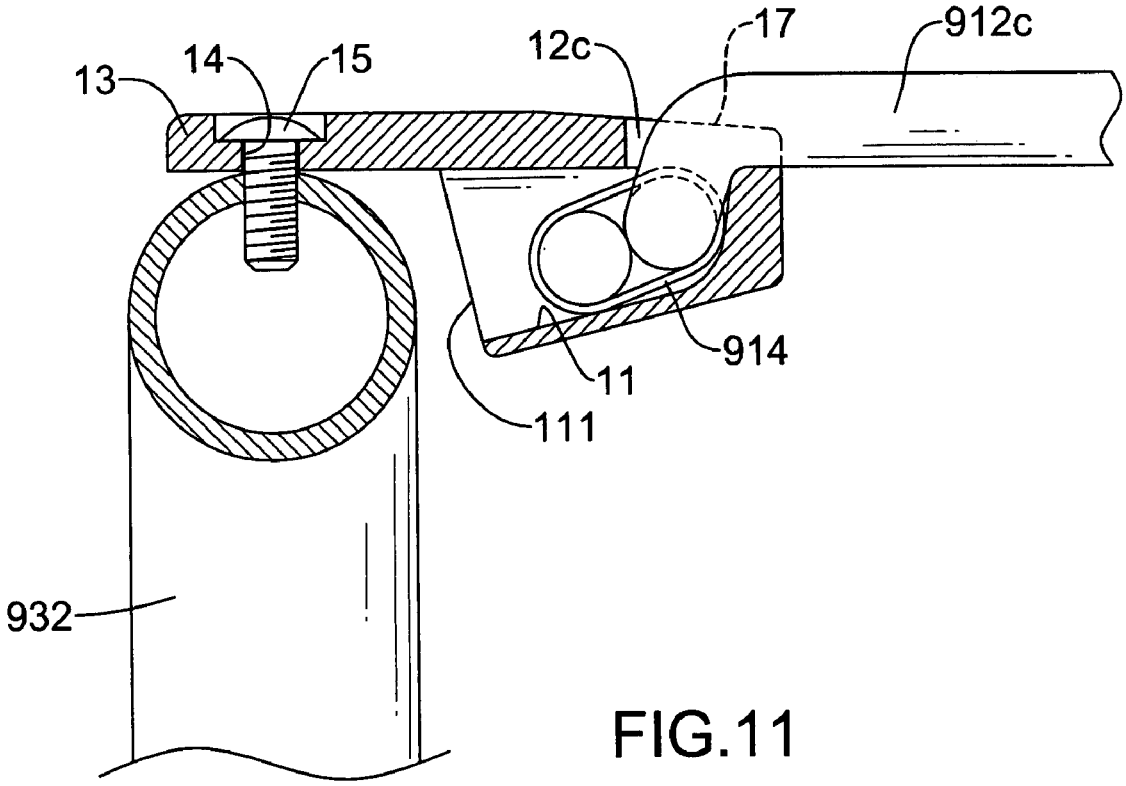
FIG. 11 is an enlarged rear view in partial section of the chair in FIG. 9.
Figure 12:
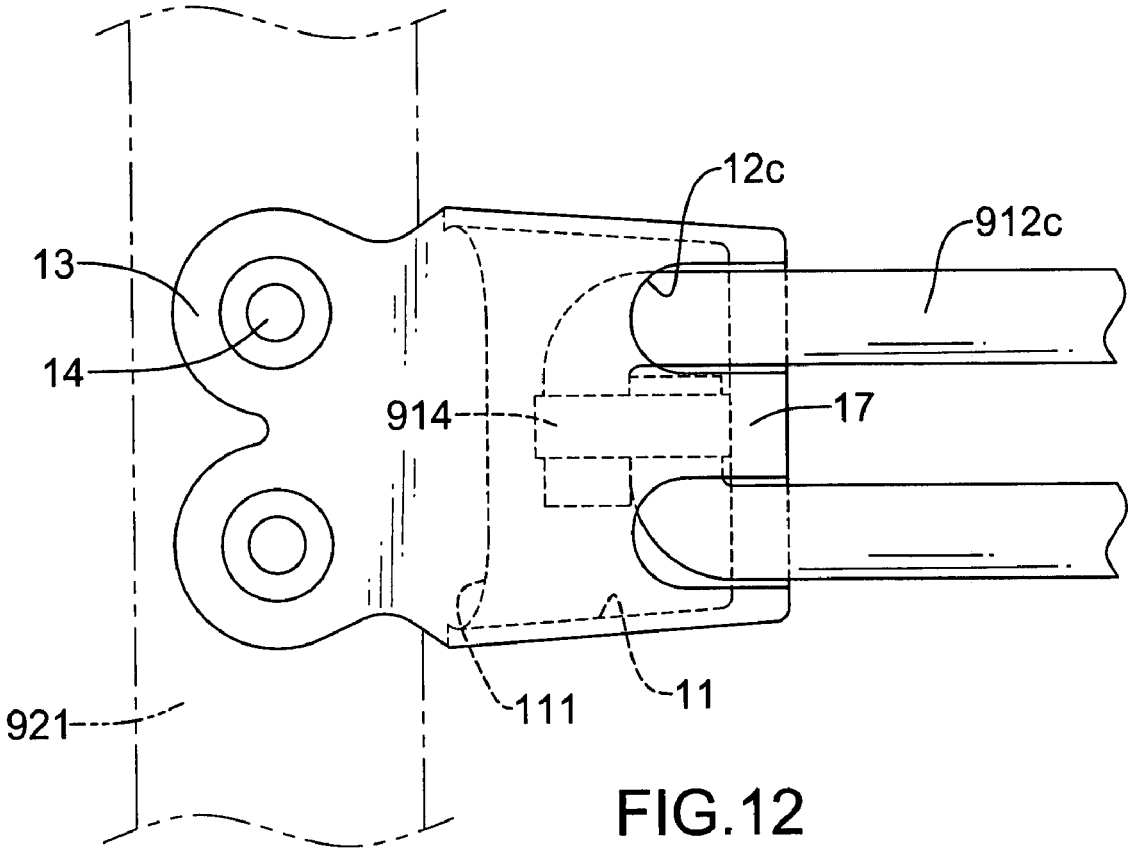
FIG. 12 is an enlarged top view of the chair in FIG. 9.
Figure 14:
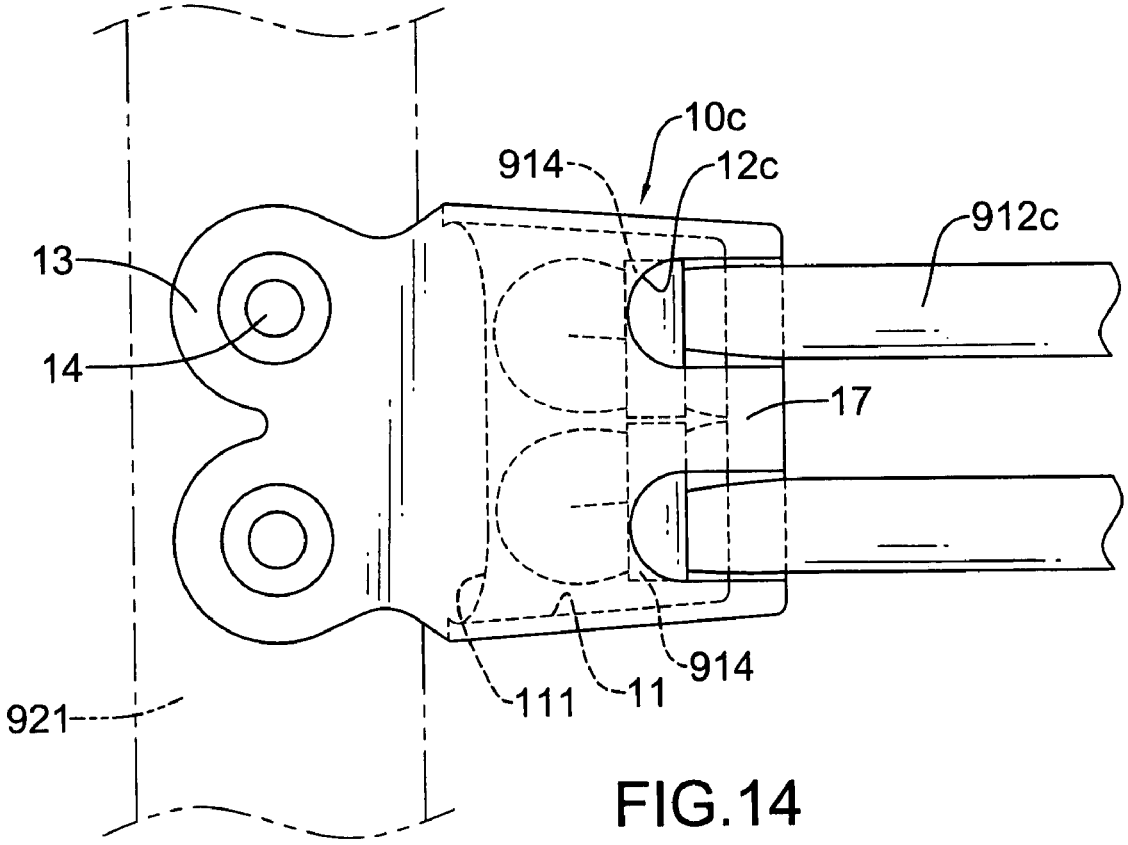
FIG. 14 is an enlarge top view of a chair with multiple third embodiments of connectors in accordance with the present invention showing that two folded ends of a round stretch strap are respectively held in two minor slots.
Figure 15:
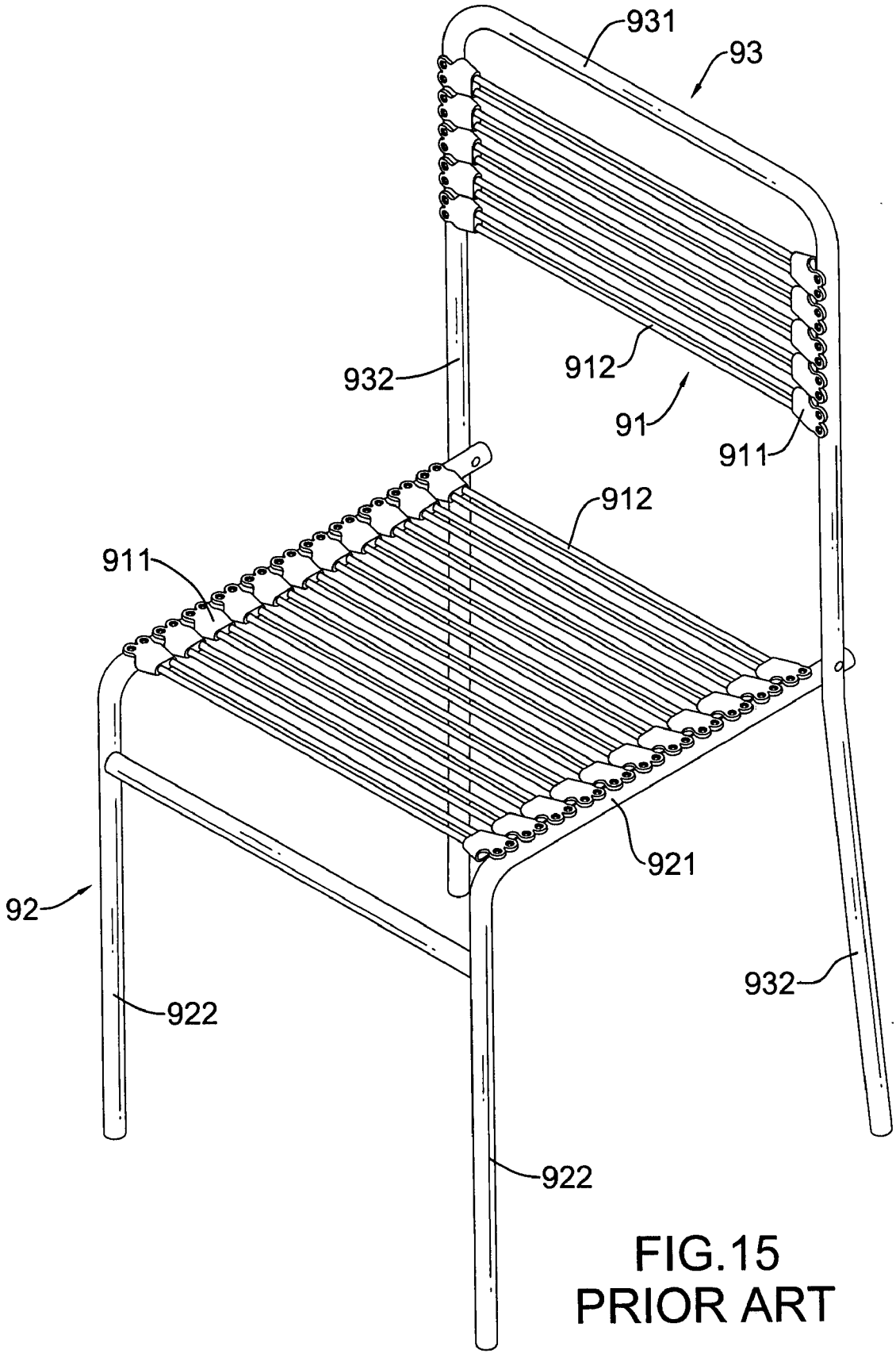
FIG.15 PRIOR ART
FIG. 15 is a perspective referenced view of a chair with multiple conventional connectors in accordance with the prior art.
Figure 16:
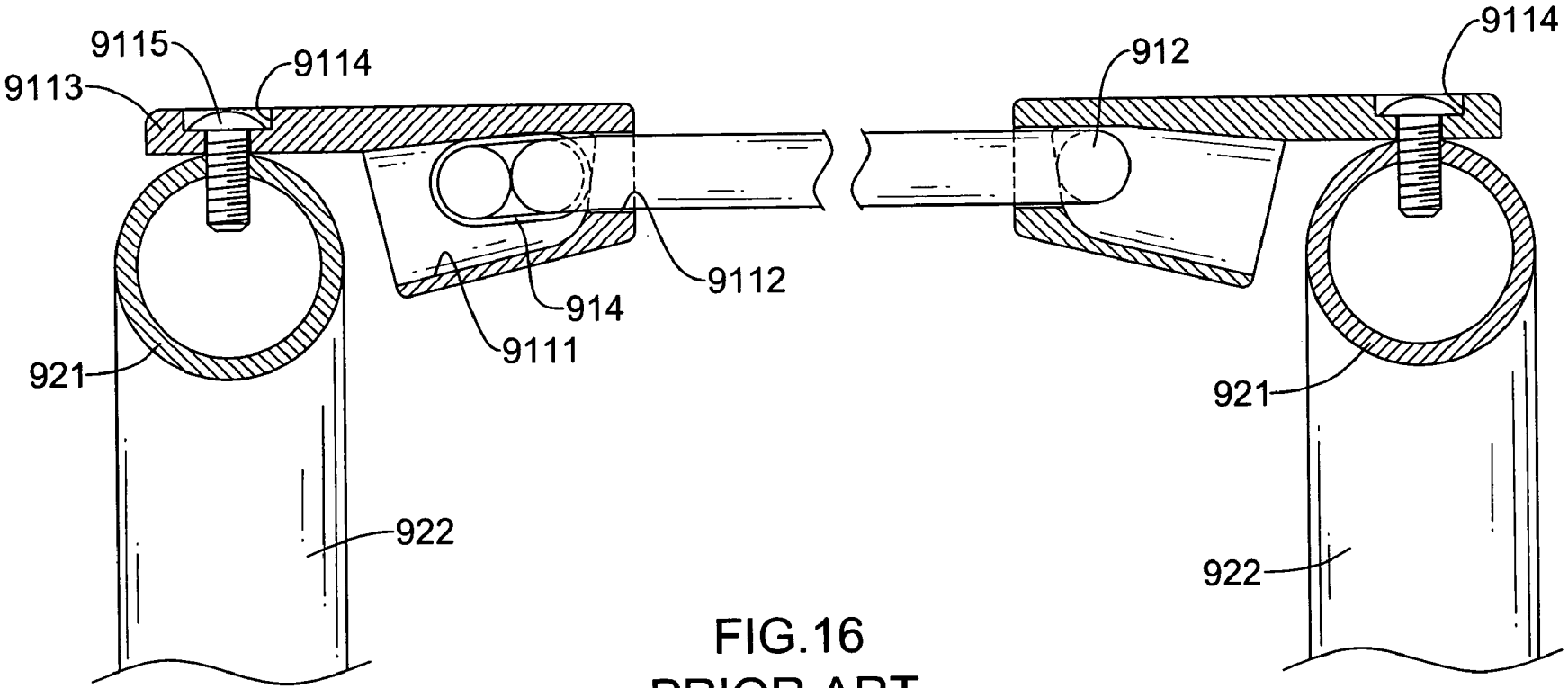
FIG.16 PRIOR ART
FIG. 16 is a rear view in partial section of the chair in FIG. 13.

With further reference to FIGS. 11, 12 and 14, in a third embodiment of the connecting slot (12*c*), the connecting slot (12*c*) has a partition panel (17). The partition panel (17) is formed longitudinally in the connecting slot (12*c*) to form two minor holes in the connecting slot (12*c*) for retaining a round stretch strap (912*c*, 912*c*') in several manners.

With further reference to FIGS. 11 and 12, in a first manner to retain the round stretch strap (912*c*), the round stretch strap (912*c*) is elastic, extends through the minor slots in the connecting slots (12*c*) in two corresponding connectors (10*c*) respectively mounted on the seat supports (921) of the L-shape bars (92) or on the legs (932) of the U-shape bar (93), encircles the partition panel (17) of the connectors (10*c*) to form a loop and has a top, a bottom and two ends. The ends of the round stretch strap (912*c*) are overlapped together in the receiving recess (11) of one of the connectors (10*c*) and are held securely by a binder (914) larger than the minor holes to be prevented from detaching from the connecting slots (12*c*). The binder (914) is smaller than the opening (11) of the receiving recess (11) and can be disposed in the receiving recess (11) from the opening (11).

With further reference to FIG. 14, in a second manner to retain the round stretch strap (912*c*'), the round stretch strap (912*c*') is elastic, extends through the minor slots in the connecting slots (12*c*) in two corresponding connectors (10*c*) respectively mounted on the seat supports (921) of the L-shape bars (92) or on the legs (932) of the U-shape bar (93) and has a top, a bottom and two folded ends. The folded ends of the round stretch strap (912*c*') are respectively held in the minor slots in the connecting slot (12*c*) in one of the corresponding connectors (10*c*). Each folded end of the round stretch strap (912*c*') is held securely by a binder (914) larger than the minor slot to be prevented from detaching from the connecting slot (12*c*). The binder (914) is smaller than the opening (11) of the receiving recess (11) and can be disposed in the receiving recess (11) from the opening (11).

Because the connecting slots (12*a*, 12*b*, 12*c*) is formed through the top of the connector (10*a*, 10*b*, 10*c*), the bottom of the stretch strap (912*a*, 912*b*, 912*c*) extending through the connecting slot (12*a*, 12*b*, 12*c*) is propped out by the top edge of the connecting slot (12*a*, 12*b*, 12*c*). Thus, the top of the stretch strap (912*a*, 912*b*, 912*c*) is protrudent relative to the top of the connector (10*a*, 10*b*, 10*c*) and is also protrudent relative to a sharp edge formed between the top and the frond end of the connector (10*a*, 10*b*, 10*c*). Additionally, the sharp edge is partially covered by the stretch strap (912*a*, 912*b*, 912*c*). So, when a user sits on the chair, the user's buttocks and back are prevented from contacting with the rigid top and sharp edge of the connector (10*a*, 10*b*, 10*c*) to gain a comfortable tactile feeling. Furthermore, the user's clothes are protected from rubbing with or fraying by the sharp edge.

The mounting ear (13) is formed on and protrudes from the rear end of the connector (10*a*, 10*b*, 10*c*) and is mounted securely on the seat support (921) of the L-shape bar (92) or the leg (932) of the U-shape bar (93). The at least one mounting hole (14) is formed through the mounting ear (13). The at least one fastener (15) is mounted through the at least one mounting hole (14) and penetrates into the seat support (921) of the L-shape bar (92) or into the leg (932) of the U-shape bar (93) to secure the connector (10*a*, 10*b*, 10*c*) on the seat support (921) of the L-shape bar (92) or on the leg (932) of the U-shape bar (93).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector for a stretch strap of a chair, the stretch strap having a top, a bottom and two ends, said connector comprising:

a top;

a bottom;

a front end;

a rear end;

a sharp edge formed between the top and the front end;

a receiving recess formed inside the connector; and a mounting ear formed on and protruding from the rear end of the connector;

at least one mounting hole formed through the mounting ear;

at least one fastener mounted through the at least one mounting hole; and a connecting slot formed through the top of the connector, communicating with the receiving recess and having a top edge, wherein one end of the stretch strap is adapted to extend through the connecting slot to be received in the receiving recess, the bottom of the stretch strap being propped out by the top edge of the connecting slot to cover the sharp edge of the connector, the top of the stretch strap protruding relative to the top and the top edge of the connector.

2. The connector as claimed in claim 1, wherein the connecting slot is vacant.

3. The connector as claimed in claim 1, wherein the connecting slot has a retaining beam formed transversely in the connecting slot.

4. The connector as claimed in claim 1, wherein the connecting slot has a partition panel formed longitudinally therein.

5. The connector as claimed in claim 1, wherein the receiving recess further has an opening communicating with the rear end of the connector.

* * * * *